United States Patent [19]

Fogelberg et al.

[11] Patent Number: 4,835,661

[45] Date of Patent: May 30, 1989

[54] ENHANCED LIGHTING UNIT FOR DISPLAYABLE MATERIALS

[76] Inventors: Weymouth Fogelberg, 1230 Dublin St., Chandler, Ariz. 85224; Clement V. Fogelberg, 360 Concord Dr., Sedona, Ariz. 86336

[21] Appl. No.: 191,840

[22] Filed: May 6, 1988

Related U.S. Application Data

[63] Continuation of Ser. No. 874,697, Jun. 16, 1986, abandoned.

[51] Int. Cl.[4] ..... G09F 13/04

[52] U.S. Cl. ..... 362/97; 362/223; 362/31; 362/311; 362/346; 40/152.2; 40/546

[58] Field of Search ..... 362/97, 31, 147, 223, 362/307, 311, 806, 812, 346; 40/152.2, 540, 549, 558, 553, 575, 361, 367, 546, 564

[56] References Cited

U.S. PATENT DOCUMENTS

| | | | |
|---|---|---|---|
| 24,728 | 10/1959 | De Montebello . | |
| 1,320,537 | 11/1919 | Dimond | 362/97 |
| 2,170,377 | 8/1939 | Nisle | 40/152.2 |
| 2,297,851 | 10/1942 | Wyss | 362/223 |
| 2,335,951 | 12/1943 | Mansell | 40/553 |
| 2,487,403 | 11/1949 | Wisdom | 40/152.2 |
| 2,549,928 | 4/1951 | Reefe | 40/152.2 |
| 2,602,252 | 7/1952 | Shinn | 362/97 |
| 2,858,629 | 11/1958 | Carter | 40/367 |
| 2,902,787 | 9/1959 | Cook | 40/564 |
| 3,242,328 | 3/1966 | Kapany et al. | 362/31 |
| 4,059,916 | 11/1977 | Tachihara et al. | 362/31 |
| 4,373,282 | 2/1983 | Wragg | 40/546 |
| 4,386,476 | 6/1983 | Schulman | 40/152.2 |
| 4,468,873 | 9/1984 | Ozeki | 40/361 |

FOREIGN PATENT DOCUMENTS

| | | | |
|---|---|---|---|
| 355787 | 8/1931 | United Kingdom | 40/546 |

OTHER PUBLICATIONS

"Three Methods for Lighting Panels; Why Backlighting is Best", *Electronic Design,* Aug. 2, 1961, p. 47, (401546).

*Primary Examiner*—Ira S. Lazarus
*Assistant Examiner*—D. M. Cox
*Attorney, Agent, or Firm*—Robert E. Harris

[57] ABSTRACT

An enhanced lighting unit is disclosed that is particularly useful for lighting displayable materials such as photographs, paintings, graphics and the like. The unit is compact and includes a housing having display positioning elements that define a planar display area for viewing of displayable materials thereat. The display area can be adjacent to a display surface, such as is provided, for example, by a picture frame, for receipt of the material to be displayed thereat. The unit also includes a light diffusing surface in the housing opposite to, and substantially coextensive with, the planar display area with the light diffusing surface being disposed so that the distance between the planar display area and the light diffusing surface continually decreases along their entire lengths. A low wattage light source is attached, within the housing, adjacent to the end of the light diffusing surface wherein the distance between the light diffusing surface and the planar display area is greatest, all other components of the lighting, for example a ballast, being located outside of the housing to thereby reduce heat within the unit. In this manner, light from the light source is evenly diffused throughout the housing by the light diffusing surface thereby enhancing illumination of the material displayed at the planar display area while not necessitating increased housing depth to illuminate larger display surfaces.

19 Claims, 3 Drawing Sheets

ENHANCED LIGHTING UNIT FOR DISPLAYABLE MATERIALS

This application is a continuation of application Ser. No. 874,697, filed June 16, 1986, now abandoned.

FIELD OF THE INVENTION

This invention relates to enhanced lighting units and, more particularly, relates to free standing or wall mountable enhanced lighting units for lighting displayable materials.

BACKGROUND OF THE INVENTION

Units for enhancing display of various displayable materials are well known and/or utilized and include units for back-lighting of such materials.

In particular light-boxes having displayable material on one face thereof and employing reflectors and light sources within the box to achieve back-lighting are known and/or utilized. One such arrangement, for example, is described in U.S. Pat. No. Re. 24,728 to R. DeMontbello issued Oct. 27, 1959 wherein a concave reflector is used for reflecting light from a light source to back-light various displayable material, a focal axis of the curved reflector being formed at the midportion of the curved reflector requiring a deeper curve as the area to be illuminated grows.

A second lighting arrangement is shown, for example, in U.S. Pat. Nos. 1,320,537, issued Nov. 4, 1919 to C. W. Diamond, and 2,297,851 issued Oct. 6, 1942 to Wyss, Jr. As described therein, a reference surface is illuminated by use of a reflector and light source beneath (or channeled beneath) the surface, the reflector being parallel to the surface throughout most of its length and curving toward the surface only at the end thereof.

A third example of a lighting arrangement is shown in U.S. Pat. No. 2,487,403 issued Nov. 8, 1949 to R. I. Wisdom. As described in this patent, the device employs a convex reflector behind the surface to be illuminated which is disposed along a portion of the rear wall of a light-box.

Thus, while units for enhanced lighting of various surfaces have heretofore been suggested and/or utilized, further improvement could nevertheless still be utilized.

SUMMARY OF THE INVENTION

This invention provides an improved unit for enhanced lighting, particularly of displayable materials, such as, for example photographs, paintings, graphics and the like. The unit is compact and includes a housing with display positioning elements which define a planar display area for viewing of displayable materials thereat. The unit can be utilized by itself, and/or can be utilized with a display device, such as, for example, a picture frame, for receipt of the materials for display. The housing includes a light diffusing surface opposite to, and substantially coextensive with, the planar display area, and a light source between the light diffusing surface and display surface. The light diffusing surface is disposed within the housing so that the distance between the light diffusing surface and the planar display area continually decreases along their entire lengths, with the light source residing at the widest separation therebetween, with the separation therebetween preferably decreasing more rapidly through the midsections than at the opposite ends. In this manner, an evenly distributed back-lighting of the material at the planar display area is achieved.

It is therefore an object of this invention to provide an improved enhanced display unit.

It is another object of this invention to provide an improved unit for enhanced display of displayable material.

It is another object of this invention to provide a compact unit for back-lighting of photographs, paintings, graphics and the like.

It is another object of this invention to provide an enhanced lighting unit that is usable by itself or in conjunction with conventional display devices.

It is still another object of this invention to provide an enhanced lighting unit that is adaptable for wall mountable or free standing display.

It is yet another object of this invention to provide a compact unit for enhanced display of displayable material having an internal illumination source but which minimizes heat produced within the unit.

It is still another object of this invention to provide an improved unit for enhanced lighting of displayable material which is capable of use in association with standard frames, including molded acrylic desk picture frames of various sizes.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
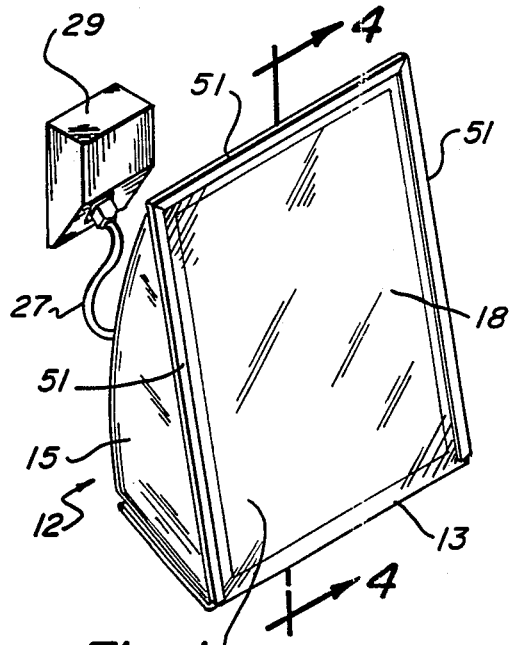
FIG. 1 is a front perspective view of a displayable device having the enhanced lighting unit of this invention incorporated therein.

Referring now to the drawings, a free-standing unit 12 for enhanced lighting of displayable materials is shown in FIGS. 1 through 6 utilized in conjunction with a display device 13. As shown, unit 12 includes a housing 15 the front edges of which provide display positioning elements, or flanges, 16, which elements define a planar display area 18 for receipt of materials to be displayed thereat. While not specifically shown, it is to be realized that displayable materials could be placed at planar display area 18 and be viewed thereat without use of an additional holding, or display, device 13, such as, for example, a frame.

Figure 3:
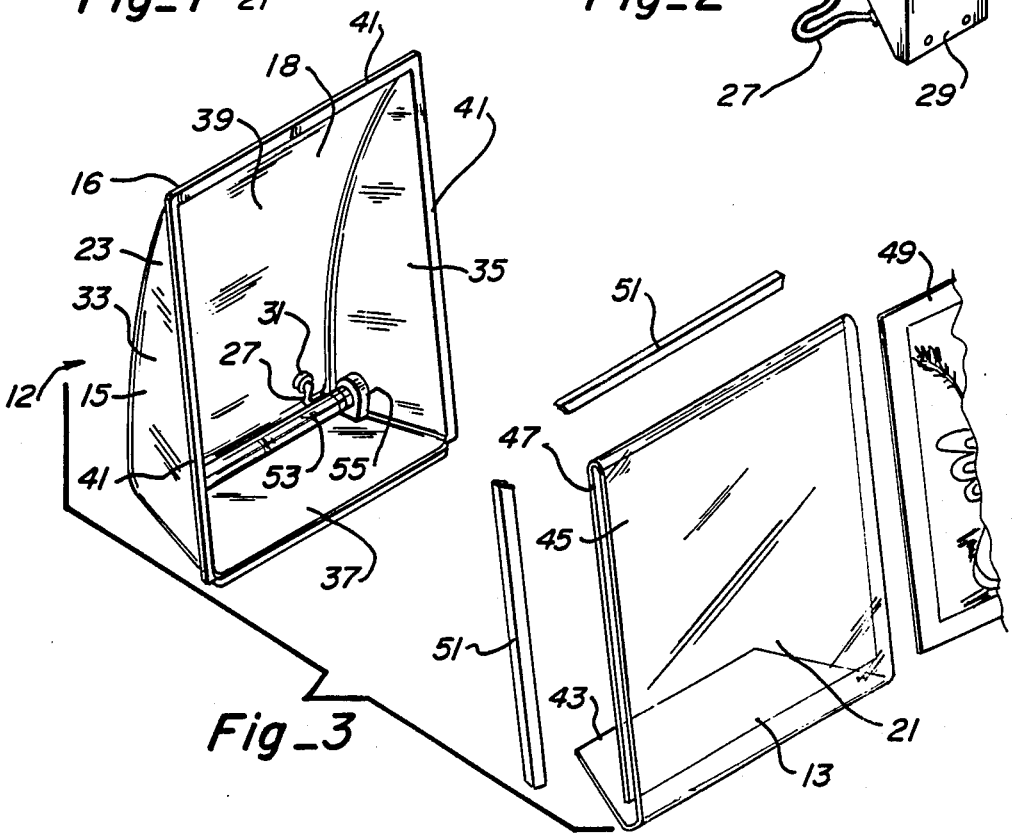
FIG. 3 is an exploded perspective view of the device shown in FIG. 1 and better illustrating the relationship between the display device and the enhanced lighting unit of this invention.

As shown in FIGS. 1 and 3, display device 13 can, however, be utilized, with the display surface 21 of such a device being positioned at planar display area 18 adjacent to, or contacting, positioning elements 16 (i.e., the front edges of housing 15 as specifically shown). As shown in FIG. 1, display device 13 can be, for example, a conventional molded acrylic desk picture frame.

Figure 2:
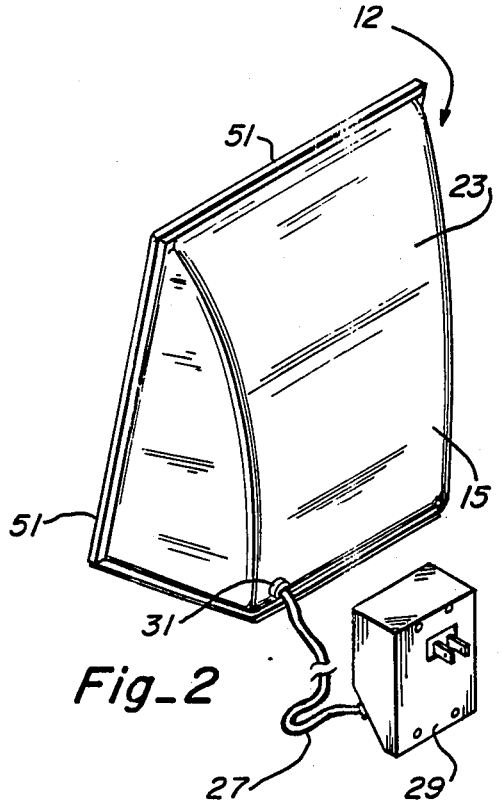
FIG. 2 is a rear perspective view of the device shown in FIG. 1.

Housing 15, as shown in FIGS. 1, 2 and 3, provides a wedge-shaped partial enclosure 23 adapted to receive molded frame 13 so that the display surface 21 of the frame spans and is positioned along planar display area 18.

Power connection 27 and ballast 29 are external to housing 15 thereby reducing heat within the unit by locating the heat producing elements of a standard fluorescent lighting system external to the unit. As shown in FIG. 2, power connection 27 exits housing 15 through grommet 31 for protection of power connection 27 from fraying and the like.

Referring to FIG. 3, an exploded view of enhanced lighting unit 12 is shown partially adaptable for use with frame 13. As shown, wedge-shaped enclosure 23 has substantially triangular side walls 33 and 35, base portion 37 and light diffusing rear wall 39. The triangular side walls, base portion, and light diffusing rear wall all combine to form a partial enclosure having planar display area 18 at the front thereof. Positioning elements 16 defining planar display area 18 are formed by flanges, or a collar, 41 extending partially around the front edges of the unit.

Figure 7:
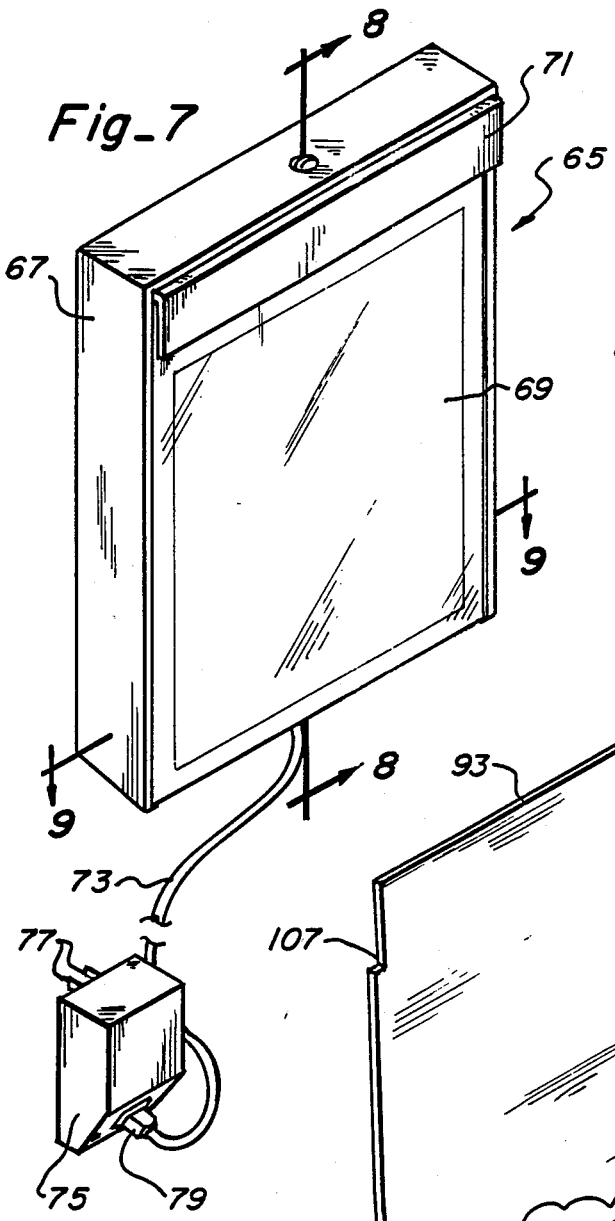
FIG. 7 is a front perspective view of a second embodiment of the enhanced lighting unit of this invention that is particularly useful for wall mountable display.
Figure 8:
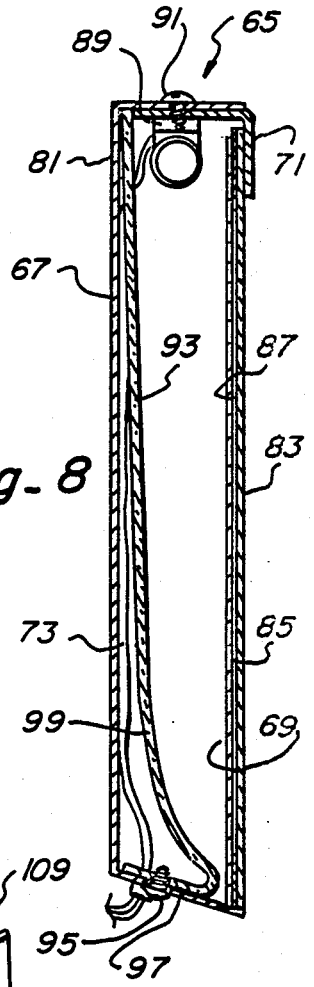
FIG. 8 is a sectional view taken through lines 8—8 of FIG. 7.

Molded desk frame 13 includes base section 43 and overlapping faces 45 and 47. The molded desk frame is of clear acrylic material and can be any of a large range of sizes currently well known and in commercial usage. The material for display, herein photograph 49, is mounted between the overlapping faces 45 and 47 of the desk frame 13 (better shown in FIG. 4). Retainer clips 51 (or other conventional fasteners) may be used to maintain molded frame 13 on wedge-shaped enclosure 23 at connecting collar 41 (as more fully set forth hereinbelow). Fluorescent bulb 53 resides within bulb receptacle 55 in base portion 37, and may be, for example, a low wattage fluorescent unit. Bulb receptacle 55 may be secured to base portion 37 in any conventional manner, including, for example, through use of adhesives. While not specifically shown, a glare shield, such as described hereinafter with respect to the alternate embodiment of the invention as shown in FIGS. 7 and 8, may also be utilized.

Figure 4:
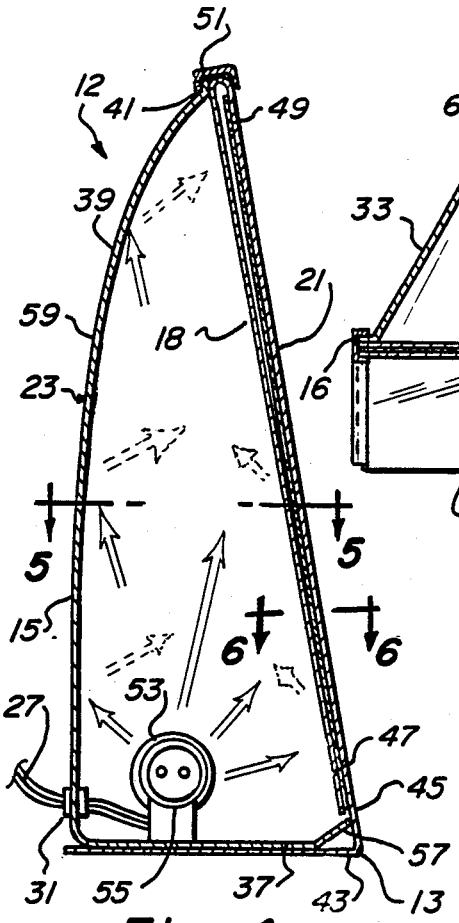
FIG. 4 is a sectional view taken through lines 4—4 of FIG. 1.

Referring now to FIG. 4, this sectional view best illustrates the relationship of the molded desk frame portion and the wedge-shaped enclosure portion of housing 15. Molded frame 13 receives wedge-shaped enclosure 23 with base portion 37 residing over the base 43 of frame 13, lip 57 of base portion 37 meeting overlapping faces 45 and 47 just below face 47. At the top of unit 12, retainer clip 51 slides over connecting collar 41 and the top of frame 13 and in a gripping fashion holds the connecting collar adjacent the frame.

Also as shown in FIG. 4, light diffusing rear wall 39 between base portion 37 and connecting collar 41 resides in a spaced relationship from display surface 21, the distance between display surface 21 (and hence planar display area 18) and light diffusing rear wall 39 continually decreasing between base portion 37 and the upper portion of connecting collar 41. As also shown, at the midsection 59 of light diffusing rear wall 39 the distance between rear wall 39 and display surface 21 begins to decrease more rapidly than at portions nearer base portion 37 thereby forming a curve having an increasing angle of curvature as the rear wall 39 approaches frame 13.

In this fashion, light from bulb 53 is diffused by light diffusing rear wall 39 and spread evenly throughout the interior of the unit and at the overlapping faces 45 and 47 of frame 13. Light diffusing rear wall 39 is not necessarily the only light diffusing surface within the unit, side walls 33 and 35 and base portion 37 also being capable of light diffusing as is overlapping face 47 of frame 13, thereby further diffusing light for increased evenness of distribution at the surface of the overlapping faces 45 and 47 of frame 13 and therefore the material 49 housed within the frame, without the necessity of a bright bulb which could create excessive heat within the unit and could cause bright spots at display area 18.

Figure 5:
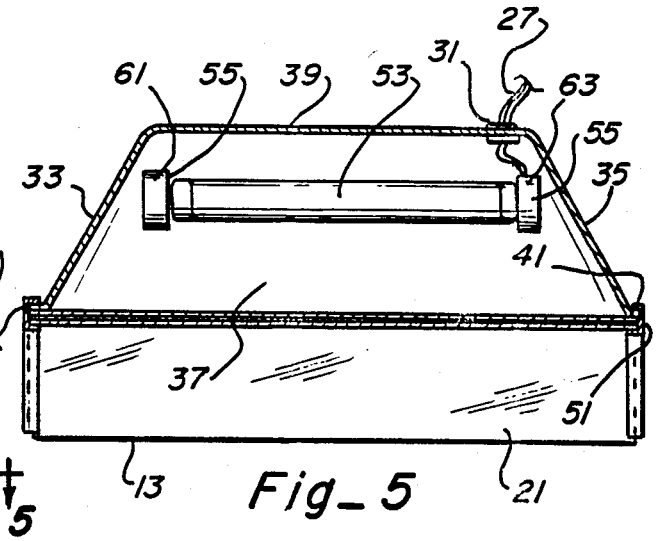
FIG. 5 is a sectional view taken through lines 5—5 of FIG. 4.

As best shown in FIG. 5, base portion 37 tapers as it proceeds rearwardly. It should also be noted that side walls 33 and 35 cant outwardly at rear wall 39 thereby causing light diffusing rear wall 39 to be wider at its upper regions than near base portion 37. By thus tapering the base portion and canting the side walls the unit may be placed on either the base portion or side walls for display of materials appropriate to the chosen placement. Bulb receptacle 55 is shown to include receptacle ends 61 and 63, receptacle end 63 being connected with power connection 27 and which may, for example, include starter bulbs for bulb 53.

Figure 6:
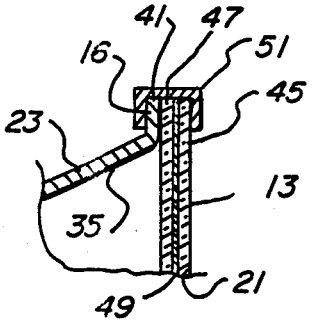
FIG. 6 is a partial sectional view taken through lines 6—6 of FIG. 4 and illustrating the means of connecting the display device with the housing.

In FIG. 6, the relationship of connecting collar 41 along side wall 35 to overlapping faces 45 and 47 is shown in better detail. Retainer clip 51 holds connecting collar 41 against overlapping faces 45 and 47, thereby releasably maintaining frame 13 in place on wedge-shaped enclosure 23.

Referring now to FIG. 7, a second embodiment 65 of the enhanced lighting unit of this invention is shown. Unit 65 includes housing 67 having planar display area 69 at the front portion thereof. Glare shield 71 resides at the upper portions of housing 67 for shielding the display area from any bright spot which may potentially be caused by the lighting source within the housing. Power connection 73 is connected to ballast 75, which ballast is provided with electrical output connecting prongs 77 (as is the ballast 29 shown in FIG. 1) for connection to a conventional AC power source. As shown, connection 73 is connected with ballast 75 by plug 79.

As shown in FIG. 8, unit 65 provides a trim, compact, internally lighted frame especially adaptable for wall mounting. Housing 67 includes enclosure 81, display surface 83 and matting 85 cooperating to enhance presentation of displayable material 87. Glare shield 71 and bulb receptacle 89 may be maintained in place by conventional fasteners, such as, for example, screw 91, as shown, or by the use of adhesives.

Light diffusing plate 93 is maintained within enclosure 81 by screw 95 through base portion 97 of light diffusing plate 93 (or by use of other conventional securing means, including adhesives). Light diffusing plate 93 is substantially coextensive with display area 69 and resides within enclosure 81 so that the distance between light diffusing plate 93 and display area 69 continually decreases along the length of light diffusing plate 93 between bulb receptacle 89 and its narrowest locus at the opposite end of enclosure 81. At its midportions 99, the space between light diffusing plate 93 and display area 69 decreases more rapidly than at its regions adjacent bulb receptacle 89 thereby forming a curve having an angle of curvature which increases as light diffusing plate 93 approaches display area 69. In this manner even distribution of light throughout the housing for presentation at the display area 69 is achieved.

Figure 9:
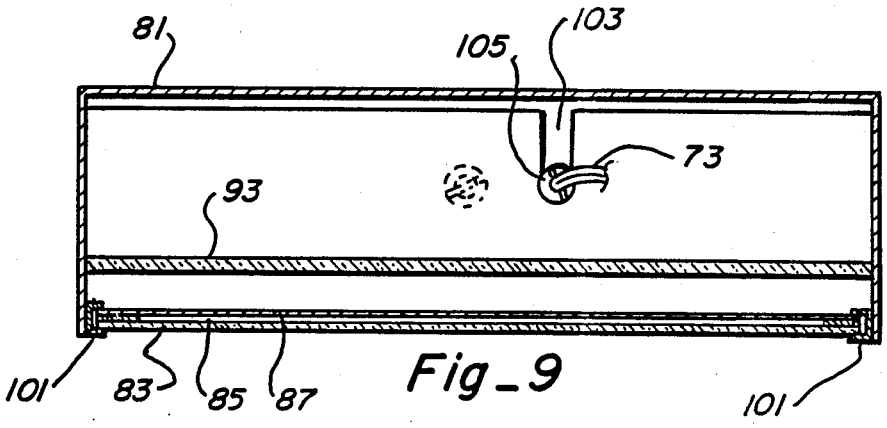
FIG. 9 is a sectional view taken through lines 9—9 of FIG. 7.
Figure 10:
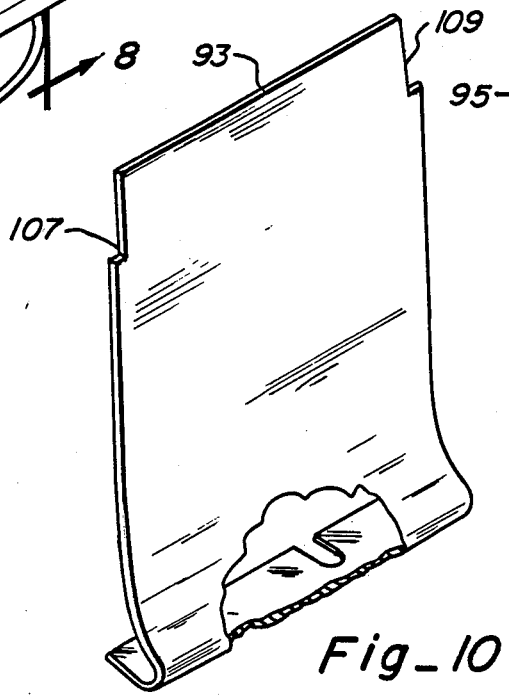
FIG. 10 is a perspective view of the light diffusing surface of the unit shown in FIG. 7.

As shown in FIG. 9, display surface 83, matting 85, and display material 87 are maintained within enclosure 81 at channels 101 connected with enclosure 81. Slot 103 in light diffusing plate 93 and enclosure 81 allows power connection 73 through grommet 105 to be freed from housing 67 for changing of a bulb in bulb receptacle 89. As shown in FIG. 10, light diffusing plate 93 includes slots 107 and 109 for passage therethrough, as the case may be, of power connection 73, thereby allowing power connection 73 to reside behind light diffusing plate 93 (as shown more clearly in FIG. 8).

The unit for enhanced lighting of displayable material made in accordance with this invention can be utilized as shown in the drawings or rotated, as desired, to achieve the desired viewing dimensions (as, for example, by rotating 90° to allow a display of a picture having a wider dimension than is the length of the picture).

The enhanced display unit of this invention is relatively simple in construction and yet is compact. The unit requires only a small, or minimum, thickness, made possible through the combination of elements utilized, yet achieves uniform lighting of displayed material. It has been found, for example, that units made according to this invention having a display area size of 8"×10" required a thickness (i.e., the front to back dimension) that did not need to exceed about one inch, while a display area size of 16"×20" did not require a thickness exceeding about one and one-half inches.

With respect to materials, the light diffusing surfaces can be constructed by any light diffusing material. The wedge-shaped enclosure 23 of the embodiment shown in FIGURE 1 may be of a unitary molded construction, and although a fluorescent lighting is shown herein, a variety of light sources could be substituted. A variety of well known framing techniques for framing materials at the display area can also be used in association with the unit herein disclosed.

Therefore, as shown, an improved enhanced lighting unit is provided that is particularly useful for lighting displayable materials, with the unit employing a light diffusing surface disposed with respect to a planar display area so that the light diffusing surface continually approaches the display area along the entire length of each, whereby a light source placed at the greatest space between the two surfaces will evenly illuminate the entire display area. Additionally, heat from the source of illumination is minimized by using low wattage bulbs and by maintaining all other heat producing elements used in association with the bulb exterior to the unit. Both free-standing and wall mountable units are shown, as is incorporation into the unit of commercially known and available frames such as molded acrylic desk frames.

What is claimed is:

1. A unit for enhanced display at an overall substantially planar area of displayable material positionable thereat, said unit comprising:

housing means having positioning means defining a substantially planar display area and first and second end sections positioned at opposite sides of said display area;

illumination means in said housing means adjacent said first end section; and light diffusing means positioned between said first and second end sections and in a spaced relationship with respect to said display area, said illumination means being disposed between said display area and said light diffusing means, said light diffusing means being substantially coextensive with said display area and having a planar portion and a curvilinear portion with said spacing between said display area and said planar portion of said light diffusing means continually decreasing between said first end section of said housing means and said curvilinear portion of said light diffusing means and with said curvilinear portion of said light diffusing means curvilinearly extending between said planar portion of said light diffusing means and said second end section of said housing means adjacent to said display area to thereby achieve even distribution of light at said display area for enhanced display of materials thereat.

2. The enhanced display unit of claim 1 wherein said light diffusing means includes a base portion for securing said light diffusing means to said second end section of said housing means, said portions of said light diffusing means being integrally formed from a substantially smooth opaque sheet material.

3. The enhanced display unit of claim 1 wherein said housing means includes wall mounting means for mounting of said housing on substantially vertical surfaces.

4. The enhanced display unit of claim 1 wherein said housing means is configured to receive a frame having a picture area positionable at said display area.

5. The unit for enhanced display of claim 4 wherein said frame comprises one of a wall mountable picture frame and a free standing picture frame.

6. The enhanced display unit of claim 4 wherein said frame is a standard molded acrylic desk picture frame.

7. The enhanced display unit of claim 1 wherein said illumination means is an elongate light bulb of low wattage thereby minimizing heat within said housing means.

8. The enhanced display unit of claim 7 wherein said illumination means includes ballast means, said ballast means being positioned outside of said housing means to minimize heat within said housing means.

9. The enhanced display unit of claim 1 wherein said positioning means includes an opaque framework section for matting of said displayable material and for shielding of said illumination means at said display area thereby reducing glare from said illumination means at said display area.

10. The enhanced display unit of claim 1 wherein said curvilinear portion of said light diffusing means forms a continual curve between said planar portion of said light diffusing means and second end section of said housing means, said curve having a constantly increasing angle of curvature as said curvilinear portion of said light diffusing means approaches said display area at said second end section.

11. A free standing unit for enhanced display of displayable material comprising:

housing means having a base portion, rear portion and first and second side portions which are connected to define an interior area and an overall substantially planar viewing area adjacent to said interior area, said portions having light diffusing surfaces facing said interior area, and said rear portion and said light diffusing surface thereof having first and second edges, said first edge being adjacent to said substantially planar viewing area and a said second edge being connected to said base portion and being shorter in length than said first edge, said rear portion and said light diffusing surface thereof having first and second parts, said first part curvilinearly extending between said first edge and said second part, and said second part being substantially planar and extending between said first part and said second edge;

displaying means configured to receive said material, said displaying means being adjacent to, and substantially coextensive with, said viewing area; and illumination means in said housing means.

12. The unit of claim 11 wherein said illumination means is mounted to said base portion of said housing means.

13. The unit of claim 11 wherein spacing between said light diffusing surface of said rear portion of said housing means and said viewing area is substantially equal at all points along any axis parallel to said first and second edges of said rear portion.

14. The unit of claim 11 wherein said illumination means is operable from an AC power source and includes ballast means, said ballast means being positioned outside of said housing means and in a spaced relationship therewith thereby minimizing heat within said housing means.

15. The unit of claim 11 wherein said curvilinear part of said light diffusing surface of said rear portion of said housing means has a constantly increasing angle of curvature as said light diffusing surface of said rear portion of said housing means approaches said first edge thereof.

16. A compact, free standing unit for enhanced lighting of displayable material comprising:

a substantially wedge-shaped housing having a light diffusing interior surface, said housing including a base section, substantially triangularly shaped opposed side wall sections, a rear wall section, and positioning means defining a substantially planar viewing area opposite said rear wall section, said rear wall section forming a continual curve between said base section and said viewing area, said curve having a constantly increasing angle of curvature as said rear wall section approaches said viewing area, said rear wall section having a first edge adjacent to said viewing area and a second edge adjacent to said base section and being shorter in length than said first edge;

displaying means having first and second transparent walls for displaying material positioned and held between said first and second walls, said displaying means being releasably securable to said positioning means of said housing; and illumination means attached to said base section of said housing so that said illumination means is adjacent to both said base section and said rear wall section.

17. The unit of claim 16 wherein said housing is of one-piece construction.

18. The unit of claim 17 wherein said displayable material is opaque and thus provides a sectional partial light diffusing surface at said viewing area to thereby provide more even lighting of said displayable material.

19. The unit of claim 18 wherein said illumination means includes ballast means, said ballast means residing outside of, and in a spaced relationship with, said housing thereby reducing heat within said unit.

* * * * *